United States Patent [19]

Traa

[11] Patent Number: 4,714,872

[45] Date of Patent: Dec. 22, 1987

[54] VOLTAGE REFERENCE FOR TRANSISTOR CONSTANT-CURRENT SOURCE

[75] Inventor: Einar O. Traa, Portland, Oreg.

[73] Assignee: Tektronix, Inc., Beaverton, Oreg.

[21] Appl. No.: 884,119

[22] Filed: Jul. 10, 1986

[51] Int. Cl.[4] ..... G05F 3/20

[52] U.S. Cl. ..... 323/314; 323/907; 323/315

[58] Field of Search ..... 323/313, 314, 315, 316, 323/907; 330/256

[56] References Cited

U.S. PATENT DOCUMENTS 4,446,419 5/1984 van de Plassche et al. ..... 323/316

FOREIGN PATENT DOCUMENTS 2054219A 2/1981 United Kingdom ..... 323/313

*Primary Examiner*—Patrick R. Salce

*Assistant Examiner*—Judson H. Jones

*Attorney, Agent, or Firm*—William S. Lovell; Paul S. Angello

[57] ABSTRACT

A voltage reference circuit (10) for a constant-current source transistor (16) of the bipolar type provides an output voltage in two components. The first voltage component varies in accordance with the negative temperature coefficient ($C_1$) of the base (58)-emitter (78) junction of a bipolar transistor (60) to compensate for temperature-related changes in the base (18)-to-emitter (22) voltage of the constant current source transistor. The second voltage component is of fixed magnitude and develops collector current ($I_0$) flow through the transistor and thereby actuates constant-current source operation. The result is a transistor constant-current source that provides a constant output current independent of temperature.

12 Claims, 3 Drawing Figures

VOLTAGE REFERENCE FOR TRANSISTOR CONSTANT-CURRENT SOURCE

BACKGROUND OF THE INVENTION

The present invention relates to constant-current sources and, in particular, to a transistor constant-current source having an applied voltage reference that compensates for temperature variations in the junction conduction voltage of the transistor to provide a constant output current independent of temperature.

Integrated circuits extensively employ balanced differential amplifiers, which require the use of a controlled constant-current source. Temperature-compensating networks are necessary in the design of a constant-current source to ensure that the gain, DC operating point, and other important characteristics of the amplifier will vary as required over the operating temperature range. These characteristics are also sensitive to variations in the bias voltage applied to the amplifier.

Differential amplifiers used in integrated logic circuits typically employ a transistor that functions as a constant-current source. In the case of a bipolar transistor, a voltage applied between its base and emitter terminals produces a flow of electrical current through its collector terminal. In the absence of compensation of some type, the collector current can change with variations in the bias voltage applied to the transistor or with temperature changes in the base-emitter diode junction of the transistor. These variations can adversely affect the performance of the integrated logic circuits by causing changes in the peak-to-peak output voltage excursions and, as a consequence, changes in the operating characteristics, such as noise margin and propagation delay. Such changes in operating characteristics are unacceptable in circuits that employ many logic circuits which operate in synchronism to accomplish a predictable logic function. Applying a regulated reference voltage to the base-emitter diode junction of the transistor will not prevent such changes in operating characteristics from occurring.

SUMMARY OF THE INVENTION

An object of the present invention is, therefore, to provide a constant-current source of the transistor type whose output current is independent of temperature and bias voltage variations.

Another object of this invention is to provide in an integrated logic circuit a voltage reference for a transistor constant-current source that develops temperature and bias voltage-invariant logic output signals of uniform peak-to-peak voltage excursions.

A further object of this invention is to provide in a constant-current source of the bipolar transistor type a voltage reference that varies with temperature to compensate for temperature-related base-to-emitter voltage variations.

The present invention is an electrical circuit that produces an output voltage which drives the base-emitter junction of a constant-current source transistor of the bipolar type. The output voltage is the sum of two components, a voltage component that varies in accordance with the negative temperature coefficient of the base-emitter junction of a bipolar transistor and a voltage component of fixed magnitude. The electrical circuit includes first and second transistors whose base terminals are electrically common and connected to the output of a differential amplifier. The collector of each of the first and second transistors is connected to a different one of a pair of resistors, through which the respective collector currents flow. The resistors develop voltages that are directly proportional to the currents flowing through the collectors. These voltages are applied to the inputs of the differential amplifier, which subtracts them. This circuit arrangement provides collector currents of equal amounts for the first and second transistors. The collector currents increase with increasing temperature of the base-emitter junctions of the transistors.

A first load resistor connected across the base and emitter terminals of the first transistor develops a current flowing through it, which current is proportional to the base-to-emitter voltage. The current flowing through this resistor decreases with increasing temperature in accordance with the negative temperature coefficient of the base-to-emitter voltage.

The above-defined three currents flow through a second load resistor and are proportioned so that their composite magnitude is constant with changes in temperature. The voltage appearing across the first load resistor constitutes the voltage component that compensates for temperature-related variations of the voltage across the base-emitter junction of the constant-current source transistor. The voltage developed across the second load resistor constitutes the constant voltage component that drives the base-emitter junction of the constant-current transistor and thereby actuates constant-current source operation. The sum of the first and second voltage components provides, therefore, a constant current flowing through the collector of the constant-current source transistor.

Additional objects and advantages of the present invention will be apparent from the following detailed description of a preferred embodiment thereof, which proceeds with reference to the accompanying drawings.

DETAILED DESCRIPTION OF PREFERRED EMBODIMENT

Figure 1:
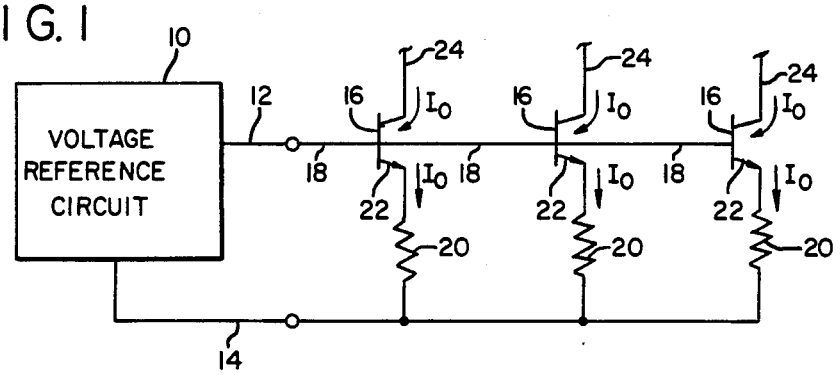
FIG. 1 shows in block diagram form the output conductors of the present invention applied to the base-emitter junctions of a series of constant-current source transistors typically used in an integrated logic circuit.

With reference to FIG. 1, the voltage reference circuit 10 of the present invention provides across its output conductors 12 and 14 an output voltage that drives the base-emitter junction of an exemplary series of three NPN transistors 16, of which each is made of silicon and functions as a constant-current source. For each transistor 16, output conductor 12 is connected to the base terminal 18, and one lead of a resistor 20 is connected to the emitter terminal 22. Output conductor 14 is connected to the other lead of the resistor 20. As will be described below, the fixed voltage component of the output voltage applied across conductors 12 and 14 also appears across resistor 20.

Figure 2:
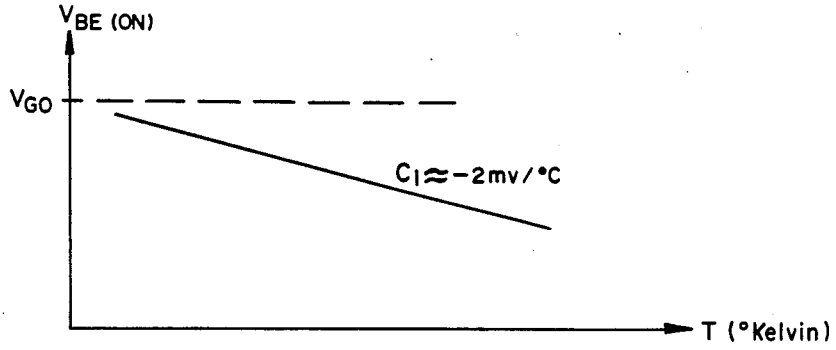
FIG. 2 is a graph showing the negative temperature coefficient of the base-to-emitter voltage of an NPN bipolar transistor in its conducting state.

FIG. 2 shows the negative temperature coefficient that characterizes the forward base-to-emitter voltage of each one of transistors 16. The parameter $V_{GO}$ represents the bandgap voltage, which is determined by extrapolating the temperature coefficient characteristic to zero degrees Kelvin and for silicon equals approximately 1.22 volts. The temperature coefficient for the base-to-emitter voltage of a bipolar transistor made of silicon is approximately 2 millivolts per degree C. Whenever a change in the base-to-emitter voltage with temperature causes a 2 millivolt per degree C. rise in voltage across resistor 20, there must be an offsetting increase of 2 millivolts per degree C. to keep the voltage across resistor 20 constant if the current $I_0$ flowing through the collector 24 and emitter 22 of transistor 16 is to remain constant. (The following discussion assumes that the collector and emitter currents in a particular transistor are the same.) The circuit of the present invention, which accomplishes the task of keeping the voltage across resistor 20 constant, is shown in schematic diagram form in FIG. 3.

Figure 3:
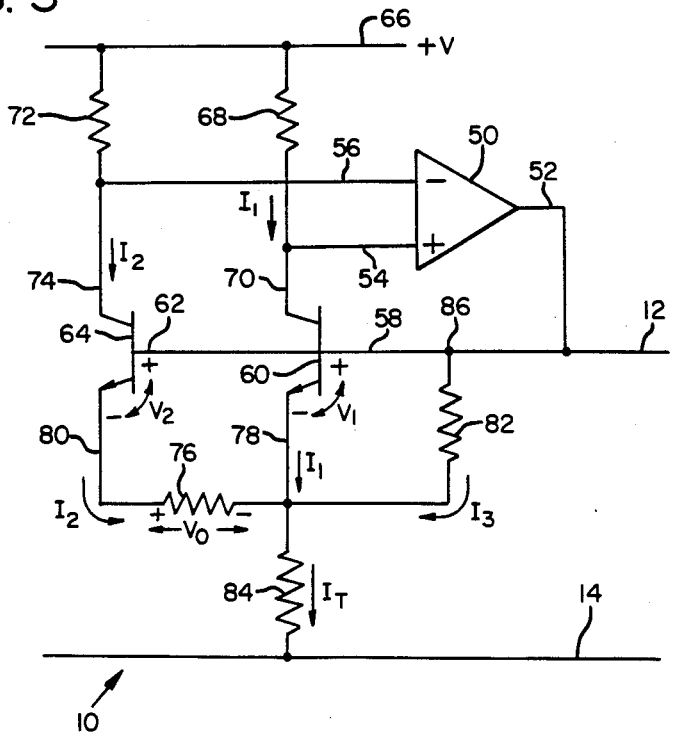
FIG. 3 is a schematic diagram of the voltage reference circuit of the present invention.

With reference to FIG. 3, circuit 10 includes an operational amplifier 50 that functions as a difference amplifier which produces a signal at its output 52. The output signal of difference amplifier 50 represents the difference between the voltage signal applied to its noninverting input 54 and the voltage signal applied to its inverting input 56. Output 52 of difference amplifier 50 is connected to the base terminal 58 of a first NPN transistor 60 and the base terminal 62 of a second NPN transistor 64. Transistors 60 and 64 are constructed with emitter regions of different areas, as will be further described below.

A conductor 66 carries a positive bias voltage "+V" that is applied through a resistor 68 to the collector terminal 70 of transistor 68 and through a resistor 72 to the collector terminal 74 of transistor 64. Resistors 68 and 72 have the same value of resistance. Collector terminal 70 of transistor 60 is electrically connected to noninverting input 54 of difference amplifier 50, and collector terminal 74 of transistor 64 is electrically connected to inverting input 56 of difference amplifier 50. A resistor 76 is connected between the emitter 78 of transistor 60 and the emitter 80 of transistor 64. A first load resistor 82 is connected between base terminal 58 and emitter terminal 78 of transistor 60. A second load resistor 84 is connected between output conductor 14 and the junction node of resistor 76 and emitter 78 of transistor 60. Output conductor 14 can be connected to a negative bias voltage or ground potential. For example, output conductor 14 would normally be connected to a negative bias voltage if voltage reference circuit 10 was used in conjunction with emitter-coupled logic (ECL) circuitry. The above-described circuit operates in the following manner to provide an output voltage of the desired characteristics.

The circuit shown in FIG. 3 is similar to a bandgap circuit of the Brokaw type that is described in *IEEE J. Solid-State Circuits,* vol. SC-9, pp. 388–393, Dec. 1974. Resistor 82, which is not included in the Brokaw circuit, introduces a current component that develops the required compensation for the base-to-emitter voltages of the constant-current source transistors 16 of FIG. 1.

As was stated above, difference amplifier 50 subtracts the voltage signals that are applied to its noninverting input 54 and its inverting input 56, and provides the amplified difference value at its output 52. Since output 52 of difference amplifier 50 drives base terminals 58 and 62 of the respective transistors 60 and 64, the voltage signals appearing at noninverting input 54 and inverting input 56 of difference amplifier 50 have equal steady-state values. The signals applied to noninverting input 54 and inverting input 56 are developed by, respectively, the flow of current $I_1$ through resistor 68 and collector terminal 70 of transistor 60 and the flow of current $I_2$ through resistor 72 and collector terminal 74 of transistor 64. Since resistors 68 and 72 have the same resistance values and difference amplifier 50 has an input impedance of sufficient magnitude so that it draws a negligible amount of current through its noninverting input 54 and inverting input 56, the signal appearing at output 52 represents the difference between the currents $I_1$ and $I_2$, which difference is nominally zero. The gain of difference amplifier 50 is sufficiently large so that, whenever the differential voltage across its noninverting input 54 and inverting input 56 is approximately but not exactly equal to zero, the negative feedback changes the voltage at output 52 by an amount that maintains the differential input voltage close to zero.

The currents $I_1$ and $I_2$ are expressed as follows:

$$I_1 \cong I_{s1} e^{\frac{+qV_1}{kT}}$$

$$I_2 \cong I_{s2} e^{\frac{+qV_2}{kT}},$$

where $I_{S1}$ and $I_{S2}$ represent the saturation currents of the base-emitter junctions (i.e., the reverse-bias leakage current of the base-emitter diode) of the respective transistors 60 and 64, k is Boltzman's constant (which equals $1.38\times10^{-23}$ watt-second per degree C.), T is the temperature in degrees Kelvin, q is the charge on an electron (which equals $1.60\times10^{-19}$ coulomb), and $V_1$ and $V_2$ are the base-to-emitter voltages of, respectively, transistor 60 and transistor 64. The above equations for $I_1$ and $I_2$ are valid under the assumptions that the collector and emitter currents for each one of transistors 60 and 64 are equal and significantly exceed $I_{s1}$ and $I_{s2}$ The voltage across resistor 76 represents the difference between the base-to-emitter voltages of transistors 60 and 64 and can be expressed as follows:

$$(V_2 - V_1) = \frac{kT}{q} \ln \frac{I_1}{I_2} + \frac{kT}{q} \ln \frac{I_{s2}}{I_{s1}}.$$

The above equation is obtained by dividing the equation for $I_1$ by the equation for $I_2$, taking the logarithm of the resulting quotient, and manipulating the constant terms.

In a preferred embodiment, the emitter region of transistor 60 has an area "A" and the emitter region of transistor 64 has an area "n×A." The ratio of $I_{S2}$ to $I_{S1}$ is, therefore, represented as "n."

Since differential amplifier 50 forces currents $I_1$ and $I_2$ to be of equal value, the first term on the right-hand side of the above equation equals zero, and the expression for the voltage across resistor 76 becomes $$(V_2 - V_1) = \frac{kT}{q} \ln n.$$

Applying Kirchoff's voltage law around the closed loop that includes the base-to-emitter voltages of transistors 60 and 64 and the voltage across resistor 76 gives the following equation:

$$V_0 = \frac{kT}{q} \ln n = R_{76} \times I_2,$$

where $R_{76}$ represents the value of resistor 76.

The total current, $I_T$, flowing through resistor 84 equals the sum of the currents $I_1$, $I_2$ and $I_3$, and can be expressed as:

$$(I_1 + I_2 + I_3) = 2I_2 + I_3 = \frac{2kT}{qR_{76}} \ln n + I_3.$$

It will be appreciated that the sum of the currents $I_1$ and $I_2$ increases with increasing temperature, as indicated by the above equation. The current $I_3$ flowing through resistor 82 can be expressed as:

$$I_3 = \frac{V_1}{R_{82}},$$

where $R_{82}$ represents the value of resistor 82.

With reference to FIG. 2, the temperature coefficient for the base-to-emitter voltage across transistor 60 can be obtained mathematically from:

$$I_3 \approx \frac{V_{GO}}{R_{82}} - \frac{C_1 \times T}{R_{82}},$$

$V_{GO}$ equals the bandgap voltage of silicon (which is approximately 1.22 volts), $C_1$ is the temperature coefficient (which is approximately 2 millivolts per degree C.), and T is the temperature in degrees Kelvin. It will be appreciated that the current flowing through resistor 82 decreases with increasing temperature in proportion to the temperature variation of the voltage across the diode junction defined by base terminal 58 and emitter terminal 78 of transistor 60.

With reference to FIG. 3, the objective in the design of the circuit is to select values for resistor 76, resistor 82, and n such that the sum of the currents $I_1$, $I_2$, and $I_3$, which equals $I_T$ and flows through resistor 84, is constant with temperature. The current $I_T$ flowing through resistor 84 can be expressed as follows:

$$I_T = \left[\frac{2kT}{qR_{76}} \ln n - \frac{C_1 \times T}{R_{82}}\right] + \frac{V_{GO}}{R_{82}}.$$

The current $I_T$ is constant with temperature if the bracketed material on the right-hand side of the above equation equals zero. Under these conditions, the values of resistor 76 and resistor 82 can be expressed as:

$$R_{76} = \frac{V_{GO}}{I_T} \times \frac{2k}{qC_1} \ln n$$

$$R_{82} = \frac{V_{GO}}{I_T}.$$

The voltage provided across output conductors 12 and 14 is, therefore, the sum of the voltages across resistor 82 and resistor 84, the former varying in accordance with the temperature variations of the base-to-emitter emitter voltage of transistor 60 and the latter being a fixed voltage independent of temperature and bias voltage supply variations. The following is an example that sets forth a stepwise procedure for designing a constant-current source voltage reference in accordance with the present invention.

EXAMPLE

The values selected for the voltage across resistor 20 and current $I_T$ in this example are 400 mV and 0.1 mA, respectively. Since the base-to-emitter voltages of transistors 60 and 16 offset each other, the voltage across resistor 84 equals the voltage across resistor 20, which is 400 mV/0.1 mA =4 kilohms. The value of resistor 82 depends on the bandgap voltage, which for a silicon device would be approximately 1.22 volts. The value of resistor 82 is, therefore, 1.22 V/0.1 mA=12.2 kilohms.

The value for resistor 76 is computed as follows. If the emitter area of transistor 64 is eight times greater than that of transistor 60, n=8 and 1 n 8 is approximately 2. At 300° Kelvin, the junction voltage of a silicon diode, which represents the base-to-emitter voltage of transistor 60, equals approximately 825 mV. The current $I_2$ flowing through resistor 76 at 300° Kelvin is $$I_2 = \frac{1}{2} \times \frac{V_{GO} - V_1}{R_{82}} = 0.0162 \text{ mA}.$$

The value of $R_{76}$ is computed from the following expression:

$$R_{76} = \frac{kT}{q \times I_2} \ln 8 = 3.2 \text{ kilohms}.$$

It will be obvious to those having skill in the art that many changes will be made in the above-described details of the preferred embodiment of the present invention. The scope of the present invention should, therefore, be determined only by the following claims.

I claim:

1. In an electrical circuit that includes a first semiconductor device which has a first junction of semiconductor materials characterized by a temperature-varying conduction voltage and which receives an applied voltage to provide at a particular temperature a constant current flow across the first junction, a method of developing an applied voltage that maintains a substantially temperature-invariant constant current flow across the first junction, comprising:

selecting a second semiconductor device which has a second junction characterized by a temperature-varying conduction voltage which is substantially the same as that of the first junction of the first semiconductor device;

developing from the second semiconductor device a first current component which changes in direct proportion to the temperature-varying conduction voltage of the second junction;

developing from the second semiconductor device a second current component which flows across the second junction and which changes in direct proportion to the temperature-varying conduction threshold voltage of the second junction;

proportioning and summing the first and second current components to provide a composite current which remains substantially constant independent of temperature;

developing a constant voltage which is proportional to the composite current; and forming the applied voltage as the sum of the constant voltage and the temperature-varying conduction voltage of the second junction, thereby to provide an applied voltage having a temperature-varying component that compensates for temperature variations in the voltage of the first semiconductor device and a constant voltage component that causes the first semiconductor device to maintain constant current flow across the first junction.

2. The method of claim 1 in which the first current component increases with increasing temperature, and the second current component decreases with increasing temperature.

3. The method of claim 1 in which the constant voltage is developed across a first resistive element by causing the first and second current components to flow through it.

4. The method of claim 1 in which the first and second current components are proportioned so that the composite current equals the sum of the first component and twice the amount of the second current component.

5. The method of claim 1 in which the first semiconductor device comprises a first transistor of the bipolar type and the first junction comprises the base-emitter junction of the first transistor, and the second semiconductor device comprises a second transistor of the bipolar type and the second junction comprises the base-emitter junction of the second transistor.

6. The method of claim 5 in which the first current component passes through a second resistive element and is derived by electrically connecting the second resistive element across the base and the emitter of the second transistor.

7. The method of claim 5 in which the second current component flows between the collector and the emitter of the second transistor.

8. The method of claim 5 in which the first and second current components are proportioned so that the composite current equals the sum of the first current component and twice the amount of the second current component.

9. An electrical circuit for developing a reference voltage for driving a constant-current source, comprising:

first and second transistors of the bipolar type having respective first and second base terminals that are electrically common;

difference amplifier means for subtracting signals corresponding to a first collector current flowing through the collector terminal of the first transistor and a second collector current flowing through the collector terminal of the second transistor, the difference amplifier means having an output that drives the first and second base terminals of the respective first and second transistors to maintain first and second currents of equal value;

first load means electrically connected across the base terminal and the emitter terminal of the first transistor for developing a third current, the third current being proportional to a voltage across the base terminal and the emitter terminal of the first transistor;

second load means through which the first and second collector currents and the third current flow to develop a fixed output voltage across the second load means; and means to apply to the constant-current source a sum of the voltages across the first and second load means, thereby to actuate temperature invariant constant-current source operation.

10. The circuit of claim 9 in which the first and second currents increase with increasing temperature, and the third current decreases with increasing temperature.

11. The circuit of claim 9 in which each one of the first and second load means comprises a resistor.

12. The circuit of claim 9 in which the constant-current source comprises a third transistor of the bipolar type, and the applied sum of the voltages in part compensates for the base-to-emitter voltage of the third transistor.

* * * * *